US006435841B1

(12) United States Patent
Kim

(10) Patent No.: US 6,435,841 B1
(45) Date of Patent: Aug. 20, 2002

(54) HERMETIC RECIPROCATING COMPRESSOR

(75) Inventor: Chul-sung Kim, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/706,160

(22) Filed: Nov. 3, 2000

(30) Foreign Application Priority Data

Mar. 7, 2000 (KR) ..... 00-11338

(51) Int. Cl.[7] ..... F04B 17/00; F04B 35/00
(52) U.S. Cl. ..... 417/363; 417/312
(58) Field of Search ..... 417/312, 363, 417/415

(56) References Cited

U.S. PATENT DOCUMENTS

| | | | | | |
|---|---|---|---|---|---|
| 4,487,555 | A | * | 12/1984 | Ohinata et al. | 417/312 |
| 4,511,314 | A | * | 4/1985 | Fraser et al. | 417/363 |
| 5,118,263 | A | * | 6/1992 | Fritchman | 417/415 |
| 5,252,038 | A | * | 10/1993 | Managyo et al. | 417/363 |
| 5,342,179 | A | * | 8/1994 | Dreiman | 417/363 |
| 5,577,898 | A | * | 11/1996 | Lee | 417/312 |
| 5,934,884 | A | * | 8/1999 | Son | 417/363 |
| 6,004,113 | A | * | 12/1999 | Vay | 417/363 |
| 6,092,999 | A | * | 7/2000 | Lillie et al. | 417/415 |
| 6,171,077 | B1 | * | 1/2001 | Calcolari et al. | 417/363 |
| 6,276,906 | B1 | * | 8/2001 | Noguchi et al. | 417/363 |

FOREIGN PATENT DOCUMENTS

| | | | | |
|---|---|---|---|---|
| JP | 404228883 | * | 8/1992 | F04B/39/00 |

* cited by examiner

*Primary Examiner*—Teresa Walberg
*Assistant Examiner*—Leonid Fastovsky
(74) *Attorney, Agent, or Firm*—Ladas & Parry

(57) ABSTRACT

A hermetic reciprocating compressor has a rigidity increasing portion for increasing the rigidity of a sealed casing of the compressor to control transmission noise that is transmitted through the sealed casing and to reduce the noise of the compressor. The rigidity increasing portion includes an elastic member which exerts elasticity between a compression device portion and a lower shell of the compressor. The elastic member increases the rigidity of the lower shell of the compressor to produce noise controlling effects similar to that which results from an increase in the thickness of the shell of the compressor itself Accordingly, noise and vibration levels are improved by the sealed casing, and the noise of the compressor can be reduced. The elastic member includes a body having an annular hole in contact with the center of the bottom of the lower shell and a plurality of supporting legs extending from the body. The lower shell of the compressor has a plurality of snubbers arranged thereon, and each supporting leg of the elastic member is connected to a respective snubber. As a result, the transmission path of the vibration, from the electronic device portion and the compression device portion to the sealed casing, is dispersed, with some of the vibration being absorbed by the sealed casing itself. Accordingly, vibration of the compressor is reduced.

13 Claims, 3 Drawing Sheets

HERMETIC RECIPROCATING COMPRESSOR

BACKGROUND OF THE INVENTION

1. Field of the Invention

The present invention relates to a compressor, and more particularly, to a hermetic reciprocating compressor employed in a refrigerator or an air conditioner to compress and discharge refrigerant.

2. Description of the Prior Art

Generally, as shown in FIG. 1, a hermetic reciprocating compressor includes a sealed casing 10 made up of upper and lower shells 11 and 12, an electronic device portion 20, which is a driving source arranged in the sealed casing 10, and a compression device portion 30 also arranged in the sealed casing 10 and driven by the driving force transmitted from the electronic device portion 20 to compress and discharge refrigerant.

The electronic device portion 20 includes a stator 21, a rotor 22, and a crankshaft 23. The crankshaft 23 is press-fit to the rotor 22 and has an eccentric portion 23*a* formed on one side thereof.

The compression device portion 30 includes a cylinder block 31 having a compressing chamber 31*a*, a piston reciprocally movable in the compressing chamber 31*a* of the cylinder block 31 in a linear direction, and a connecting rod 33 disposed between the piston 32 and the eccentric portion 23*a* of the crankshaft 23 to transform and transmit the rotary movement of the crankshaft 23 to the linear reciprocal movement of the piston 32.

In the hermetic reciprocating compressor constructed as above, when electricity is supplied, the rotary movement of the crankshaft 23 is transformed and transmitted to the linear reciprocating movement of the piston 32. The piston 32 linearly reciprocates in the compressing chamber 31*a* of the cylinder block 31 to compress and discharge refrigerant. The high speed flow of the refrigerant produces a lot of noise. In addition, there is a lot of vibration from various valves, rotating portions, and sliding portions. In order to reduce vibration and noise produced during the operation of the compressor, the hermetic reciprocating compressor employs the following noise/vibration reducing systems.

One of the noise/vibration reducing systems employed in the hermetic reciprocating compressor is a muffler system which has a suction muffler 41 disposed in the refrigerant suction channel, and a discharge muffler 42 disposed in the refrigerant discharge channel. The muffler system significantly reduces the noise from the high-speed refrigerant flow.

Another noise/vibration reducing system is a suspension system which controls the direct transmission of the vibration produced from the electronic and compression device portions 20 and 30 to the sealed casing 10. Such a suspension system 50 absorbs or damps the vibration produced from the electronic and compression device portions 20 and 30 by elastically and movably supporting the compression device portion 30 on the lower shell 12 of the sealed casing 10. The suspension system 50 includes a plurality of snubbers 51 arranged on the bottom of the lower shell 12, a plurality of protrusions 52 protruding from the lower portion of the cylinder block 31, and a plurality of suspension springs 53 disposed between the snubbers 51 and the protrusions 52 for elastically supporting the cylinder block 31.

The reference numeral 60 refers to a crankshaft stopper for restricting the movement of the electronic device portion 20 and the compression device portion 30, which are elastically and movably supported within the sealed casing 10 by the suspension system 50 and are often vertically and horizontally moved during the conveyance of the compressor into contact with the inner wall of the sealed casing 10.

By the above-described noise/vibration reducing system, noise produced during the operation of the compressor is first reduced and controlled by the muffler system and the suspension system 50, and finally reduced and controlled by the sealed casing 10.

In the conventional hermetic reciprocating compressor described above, however, the muffler system and the suspension system only reduce the noise and vibration to a certain degree. Since the rigidity of the sealed casing 10 is too weak, the noise and vibration control efficiency is deteriorated, and accordingly, noise from the compressor increases.

After the vibration produced from the electronic device portion 20 and the compression device portion 30 is first damped or reduced by the suspension springs 53, the remaining vibration is transmitted to the sealed casing 10 through the snubbers 51. Additional noise is produced from the resonance of the sealed casing 10.

The vibration transmitted to the sealed casing 10 through the snubbers 51 is directly transmitted to the compressor without being damped or reduced, thereby contributing to and increasing the vibration and noise from the compressor.

SUMMARY OF THE INVENTION

The present invention has been made to overcome the above-mentioned problems of the prior art. It is an object of the present invention to provide a hermetic reciprocating compressor capable of lowering the noise level of the compressor by increasing the rigidity of the sealed casing with minimal changes to the design of the compressor, and thus increasing the vibration/noise controlling efficiency of the sealed casing.

Another object of the present invention is to provide a hermetic reciprocating compressor capable of damping and absorbing the vibration by dispersing the transmission paths of the vibration produced from the electronic device portion and the compression device portion and transmitted to the sealed casing. Thus, the present invention controls the resonance of the sealed casing to reduce the vibration of the compressor.

The above objects are accomplished by a hermetic reciprocating compressor according to the present invention, including: a sealed casing having an upper shell and a lower shell; an electronic device portion located in the sealed casing; a compression device portion driven by the electronic device portion to compress and discharge a refrigerant; a suspension system for absorbing or damping the vibration produced from the electronic device portion and the compression device portion by elastically and movably supporting the compression device portion on the lower shell of the sealed casing; and a casing rigidity increasing portion for exerting elasticity between the compression device portion and the lower shell, thus controlling the transmission of the noise produced from the electronic device portion and the compression device portion through the sealed casing and dispersing the vibration is transmitted to the sealed casing.

Here, the casing rigidity increasing portion is made of an elastic member which can exert elasticity between the compression device portion and the lower shell of the sealed casing, to obtain a shell rigidity similar to that which results by increasing the thickness of the shell of the compressor. Accordingly, noise and vibration controlling efficiency is increased by the sealed casing, and noise of the compressor can be reduced.

The elastic member includes a body having an annular hole in contact with the center of the bottom of the lower shell, and at least four supporting legs extending from the body which are elastically connected to a plurality of snubbers arranged on the lower shell, respectively. Accordingly, the transmission path of the vibration, which is produced from the electronic device portion and the compression device portion and transmitted to the sealed casing, is dispersed among the supporting legs, and some vibration is absorbed by the sealed casing itself. Accordingly, vibration of the compressor can be reduced.

Meanwhile, on the end of each supporting leg is a groove or connecting hole whose one end is open to permit the supporting leg to be easily fitted in the snubber. The elastic member may be made of a steel plate or a plastic material having a high vibration absorbing efficiency.

BRIEF DESCRIPTION OF THE DRAWINGS

The above and other objects and advantages of the present invention will become readily apparent by reference to the following detailed descriptions when considered in conjunction with the accompanying drawings in which.

DETAILED DESCRIPTION OF THE PREFERRED EMBODIMENT

Figure 1:
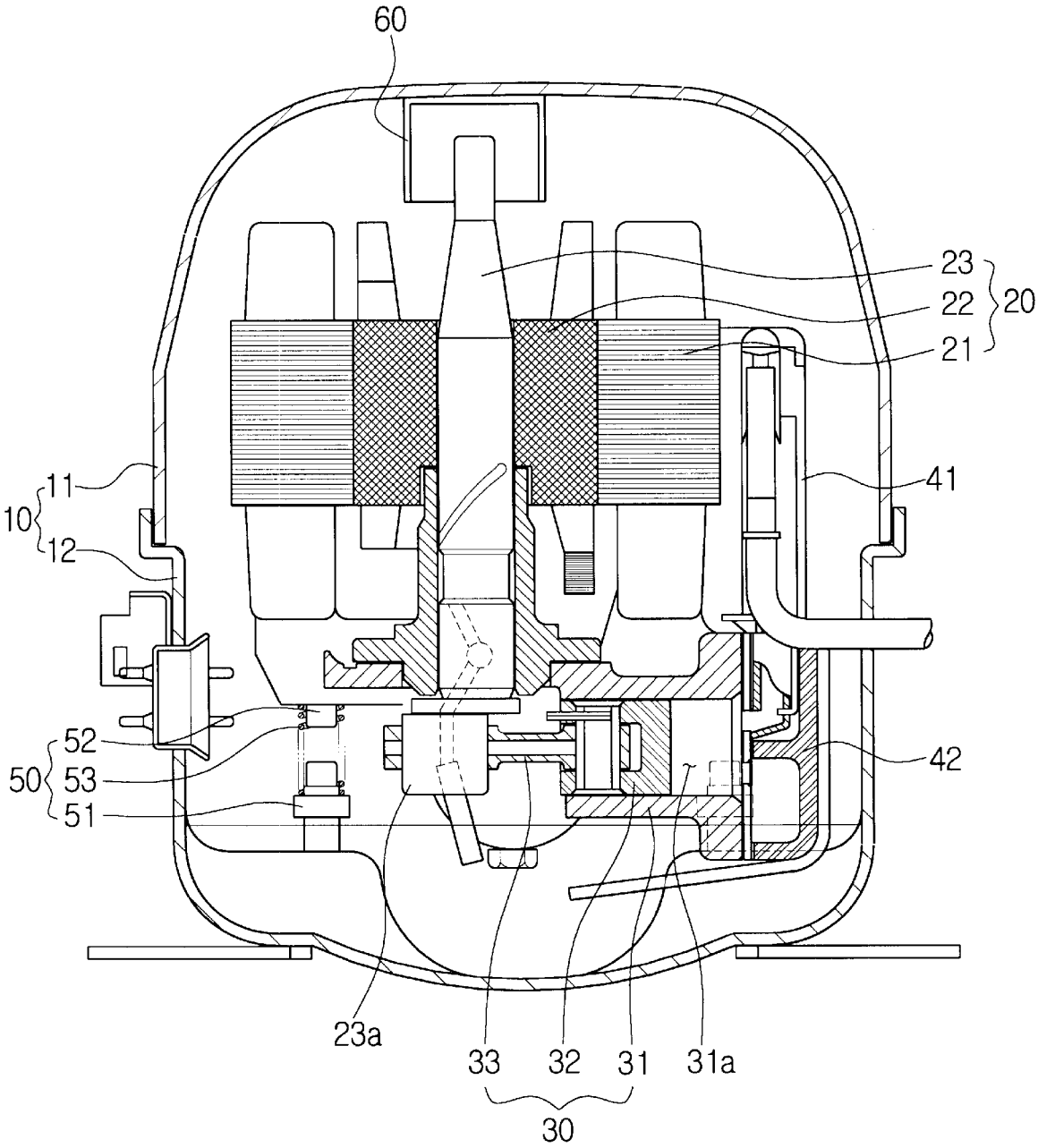
FIG. 1 (PRIOR ART)
FIG. 1 is a vertical sectional view for schematically showing the structure of a conventional hermetic reciprocating compressor.

Hereinafter, the preferred embodiment will be described in greater detail with reference to the accompanying drawings, wherein like elements are given the same reference numerals throughout for an easier explanation.

Figure 2:
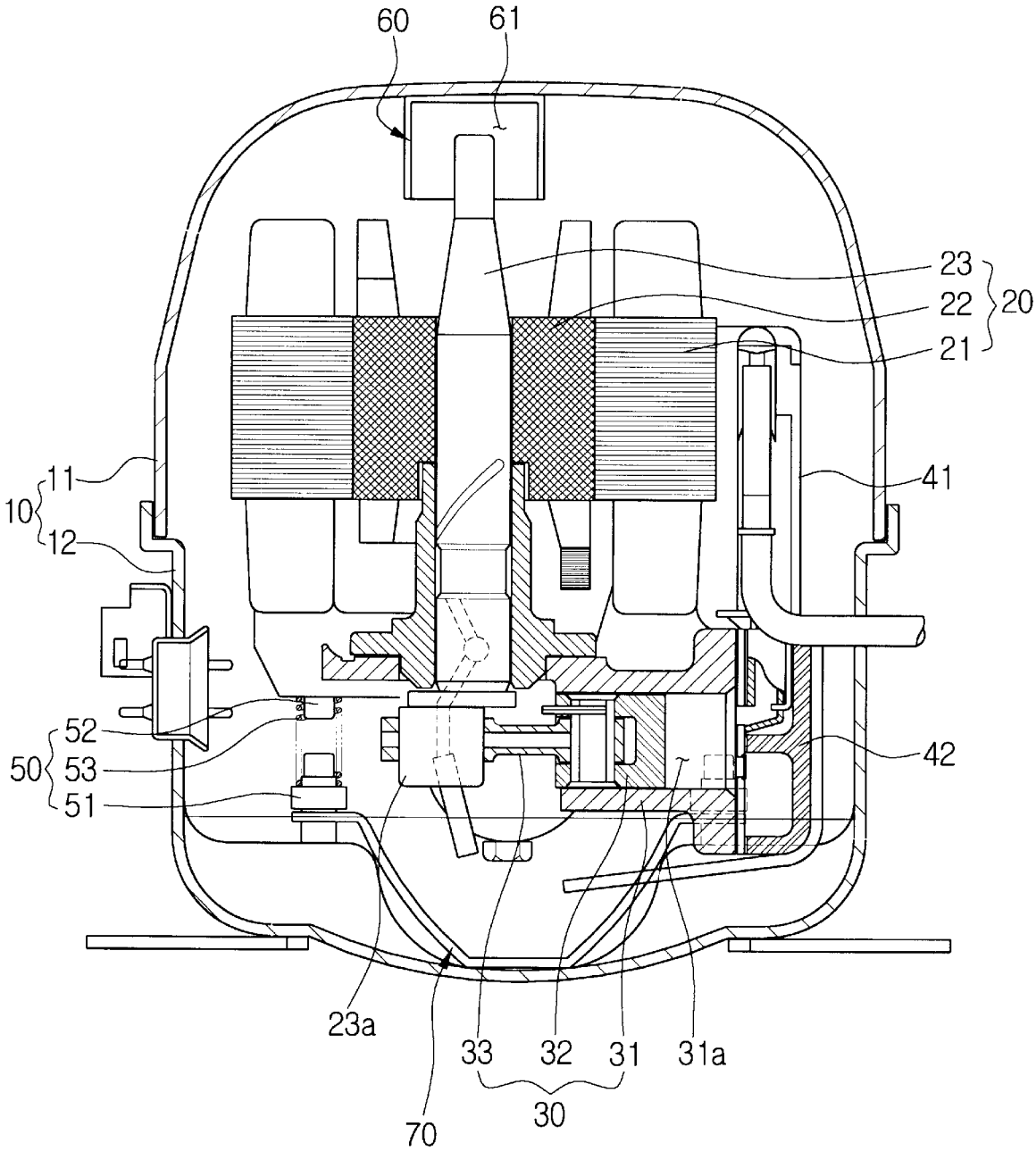
FIG. 2 is a vertical sectional view for schematically showing the structure of a hermetic reciprocating compressor according to the preferred embodiment of the present invention.

As shown in FIG. 2, the hermetic reciprocating compressor according to the present invention includes a sealed casing 10, an electronic device portion 20, a compression device portion 30, a muffler system, a suspension system 50, a crankshaft stopper 60, and an elastic member 70.

The sealed casing 10 includes upper and lower shells 11 and 12, and houses the electronic device portion 20, compression device portion 30, muffler system, suspension system 50, crankshaft stopper 60, and elastic member 70.

The electronic device portion 20 includes a stator 21, rotor 22, and a crankshaft 23. The crankshaft 23 is press-fit to the rotor 22 and includes an eccentric portion 23*a* formed on one side thereof.

The compression device portion 30 includes a cylinder block 31 having a compressing chamber 31*a*, a piston 32 reciprocally movable in the compressing chamber 31*a* of the cylinder block 31 in a linear direction, and a connecting rod 33 disposed between the piston 32 and the eccentric portion 23*a* of the crankshaft 23 to transform and transmit the rotary movement of the crankshaft 23 into the linear reciprocating movement of the piston 32.

The muffler system includes a suction muffler 41 disposed in the refrigerant suctioning channel, and a discharge muffler 42 disposed in the refrigerant discharge channel. The muffler system significantly reduces the noise created by the high speed flow of refrigerant.

The suspension system 50 absorbs and damps various vibrations produced during the operation of the compressor by elastically supporting the cylinder block 31 of the compression device portion 30 on the lower shell 12 of the sealed casing 10. Such a suspension system 50 includes a plurality of snubbers 51 arranged on the bottom of the lower shell 12, a plurality of protrusions 52 protruding from the lower portion of the cylinder block 31, and a plurality of suspension springs 53 disposed between the snubbers 51 and the protrusions 52 for elastically supporting the cylinder block 31.

The crankshaft stopper 60 restricts the movement of the electronic device portion 20 and the compression device portion 30 which are elastically and movably supported within the sealed casing 10 by the suspension system 50 and are often vertically and horizontally moved during the conveyance of the compressor into contact with the inner wall of the sealed casing 10. The crankshaft stopper 60 is welded to the upper inner portion of the upper shell 11, and includes a movement restriction hole 61 which receives the upper end of the crankshaft 23. Since the upper end of the crankshaft 23 is received and supported in the movement restriction hole 61 of the crankshaft stopper 60, the movement of the electronic device portion 20 and the compression device portion 30 is controlled, and accordingly, the possible deformation and breakage of the components of the compressor due to wide vertical and horizontal movements of the electronic device portion 20 and the compression device portion 30 into contact with the inner wall of the sealed casing during the conveyance of the compressor can be prevented.

The elastic member 70 is a rigidity increasing means for increasing the rigidity of the sealed casing 10 (the lower shell 12 in particular). The elastic member 70 increase the rigidity of the lower shell 12, bringing the same noise controlling effect as that which results from an increase in the thickness of the sealed casing 10, which is sufficient to control the transmission noise of the sealed casing 10. The elastic member 70 is disposed in such a manner that the elastic member 70 exerts elasticity between the lower shell 12 and a plurality of snubbers 51 arranged on the lower shell 12. Accordingly, since the lower shell 12 and the snubbers 51 are subjected to the elastic returning force of the elastic member 70, lower shell 12 vibrates less and its rigidity is increased.

Figure 3:
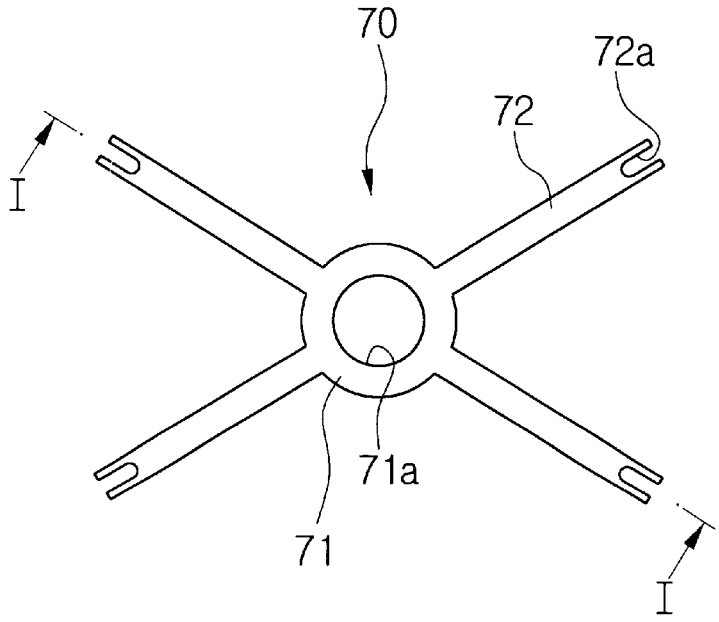
FIG. 3 is a plan view for showing the structure of an elastic member, i.e., rigidity increasing portion, which is the main feature of the present invention.
Figure 4:
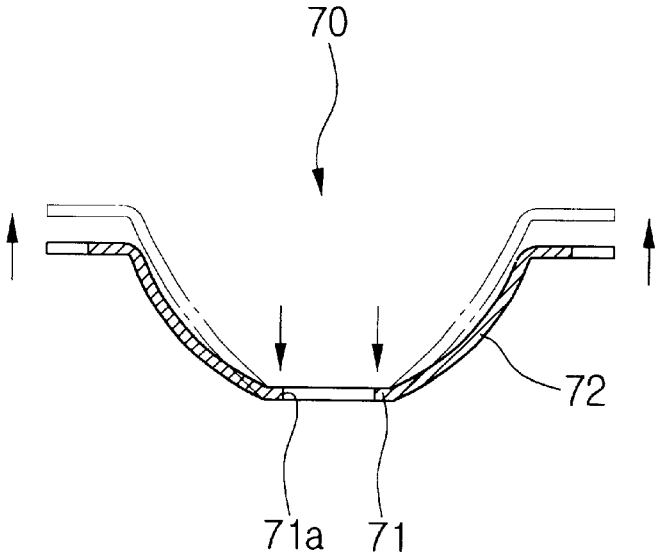
FIG. 4 is a sectional view taken along the line I—I of FIG. 3.

As shown in FIGS. 3 and 4, the elastic member 70 includes a body 71 having an annular hole 71*a*, and a plurality of supporting legs 72 integrally extending from the body 71. In this embodiment, the elastic member 70 has four supporting legs 72. The supporting legs 72 are elastically connected to the corresponding snubbers 51. Further, a groove or connecting hole 72*a* is formed in the end of each supporting leg 72 to provide a smooth fit of the respective supporting leg 72 onto the corresponding snubber 51.

The elastic member 70 may be formed of any metal material having elasticity, such as iron or steel. The elastic member 70 may also be formed of a plastic material having high vibration absorbing and damping efficiency.

The elastic member 70 not only increases the rigidity of the sealed casing 10, but also reduces the vibration by dispersing the transmission path of the vibration, which is produced from the electronic device portion 20 and the compression device portion 30 and is transmitted to the sealed casing 10, while simultaneously absorbing the vibration itself.

In the hermetic reciprocating compressor constructed as above according to the present invention, when electricity is supplied, the rotary movement of the crankshaft 23 is transformed and transmitted into the linear reciprocating movement of the piston 32 through the connecting rod 33. The piston 32 linearly reciprocates in the compressing chamber 31*a* of the cylinder block 31 to compress and discharge refrigerant.

Here, although noise and vibration are produced and dispersed through the air by the same reason described earlier in the description of the prior art, noise and vibration are significantly reduced by the operation of the elastic member 70 of the present invention. That is, the elastic member 70 increases the rigidity of the sealed casing 10, and most of the vibration, which is not permitted through the sealed casing 10, disappears. The transmission path of the vibration is dispersed from the vibration source by the elastic member 70 and absorbed and damped by the elastic member 70.

As described above, according to the present invention, the increased rigidity of the sealed casing reduces the noise within the high frequency and low frequency regions, thereby decreasing the noise level of the compressor.

Further, since the elastic member 70 disperses and damps or absorbs the vibration that is transmitted to the sealed casing 10, the vibration of the compressor also decreases.

Accordingly, quality of the compressor as well as the quality of the products employing the compressor is increased.

As stated above, a preferred embodiment of the present invention is shown and described. Although the preferred embodiment of the present invention has been described, it is understood that the present invention should not be limited to this preferred embodiment but that various changes and modifications can be made by one skilled in the art within the spirit and scope of the present invention as hereinafter claimed.

What is claimed is:

1. A hermetic reciprocating compressor comprising:

a sealed casing having an upper shell and a lower shell;

an electronic device portion located in the sealed casing;

a compression device portion coupled to the electronic device portion, the electronic device portion driving the compression device portion to compress and discharge a refrigerant;

a suspension system for absorbing or damping a vibration produced by the electronic device portion and the compression device portion, the suspension system elastically and movably supporting the compression device portion on the lower shell of the sealed casing, the suspension system transmitting the vibration along a path toward the sealed casing; and casing rigidity increasing means for exerting elasticity between the compression device portion and the lower shell to control a transmission of noise produced from the electronic device portion and the compression device portion through the sealed casing and to disperse the vibration transmitted by the suspension system.

2. The compressor as claimed in claim 1, wherein the suspension system includes a plurality of snubbers mounted on the lower shell, and wherein the casing rigidity increasing means comprises an elastic member including a body and a plurality of supporting legs extending from the body, each of the supporting legs being elastically connected to a respective snubber.

3. The compressor as claimed in claim 2, wherein the body of the elastic member has an annular hole formed therein, a portion of the body adjacent the annular hole contacting the center of the bottom of the lower shell.

4. The compressor as claimed in claim 2, wherein each supporting leg has a connecting groove formed in an end of the supporting leg, the connecting groove permitting the supporting leg to be easily coupled to the respective snubber.

5. The compressor as claimed in claim 2, wherein the elastic member is made of a steel substance.

6. The compressor as claimed in claim 2, wherein the elastic member is made of a plastic substance.

7. The compressor as claimed in claim 2, wherein there are at least four supporting legs.

8. A hermetic reciprocating compressor comprising:

a sealed casing having an upper shell and a lower shell;

an electronic device portion located in the sealed casing;

a compression device portion coupled to the electronic device portion, the electronic device portion driving the compression device portion to compress and discharge a refrigerant;

a muffler system coupled to the compression device portion;

a suspension system disposed between the compression system and the lower shell of the casing, the suspension system absorbing and damping a vibration produced by the electronic device portion and the compression device portion, the suspension system including a plurality of snubbers mounted on the lower shell and transmitting the vibration along a path toward the sealed casing; and an elastic member coupled to the suspension system to control a transmission of noise and vibration produced from the electronic device portion and the compression device portion, the elastic member including a body and a plurality of supporting legs extending from the body, the body being mounted on the lower shell, each of the supporting legs being connected to a respective snubber, whereby the elastic member disperses the vibration transmitted by the suspension system.

9. The compressor as claimed in claim 8, wherein the body of the elastic member has an annular hole formed therein.

10. The compressor as claimed in claim 8, wherein each of the supporting legs of the elastic member has an end with a connecting groove formed therein, the connecting groove facilitating connection of the supporting leg to the respective snubber.

11. The compressor as claimed in claim 8, wherein the elastic member comprises steel.

12. The compressor as claimed in claim 8, wherein the elastic member comprises plastic.

13. The compressor as claimed in claim 8, wherein the elastic member has at least four supporting legs.

* * * * *